United States Patent [19]

McLeish

[11] Patent Number: 4,541,710

[45] Date of Patent: Sep. 17, 1985

[54] CONTINUOUS COPYING APPARATUS

[76] Inventor: Bruce J. McLeish, 650 Church St., San Francisco, Calif. 94114

[21] Appl. No.: 579,155

[22] Filed: Feb. 10, 1984

[51] Int. Cl.[4] ..... G03G 21/00

[52] U.S. Cl. ..... 355/13; 355/16; 83/203

[58] Field of Search ..... 355/13, 16, 3 R, 3 TR; 83/203, 205

[56] References Cited

U.S. PATENT DOCUMENTS

| | | | |
|---|---|---|---|
| 3,672,770 | 6/1972 | Lee | 355/13 |
| 3,800,992 | 4/1974 | Yamagishi . | |
| 3,884,103 | 5/1975 | Namba | 83/205 X |
| 3,977,780 | 8/1976 | Cassano et al. | 355/3 R |
| 3,997,093 | 12/1976 | Aizawa . | |
| 3,998,118 | 12/1976 | Brophy et al. | 355/13 X |
| 4,010,882 | 3/1977 | Turner . | |
| 4,027,965 | 6/1977 | Mikasa et al. | 355/13 |
| 4,046,469 | 9/1977 | Frank et al. | 355/13 |
| 4,079,876 | 3/1978 | Malachowski . | |
| 4,086,007 | 4/1978 | Smith et al. . | |
| 4,087,172 | 5/1978 | Van Dongen . | |
| 4,110,027 | 8/1978 | Sato et al. | 355/3 TR |
| 4,185,760 | 1/1980 | McNew . | |
| 4,191,467 | 3/1980 | Scheick . | |
| 4,248,523 | 2/1981 | Doi et al. | 355/13 |
| 4,264,200 | 4/1981 | Tickner et al. . | |
| 4,265,153 | 5/1981 | Price | 83/205 X |
| 4,457,617 | 7/1984 | Tolmie | 355/13 |
| 4,465,357 | 8/1984 | Mugrauer et al. | 355/3 R |

*Primary Examiner*—R. L. Moses

*Attorney, Agent, or Firm*—Charles C. Garvey, Jr.

[57] ABSTRACT

A continuous copying apparatus provides a copier chassis having a copy paper inlet and a copy paper outlet which are on a common side of the copier chassis. A web of supply paper is positioned adjacent the copier inlet and is compactly stored so that a continuous, elongated web can be fed into the chassis at the inlet. A first roller drive positioned on the chassis and adjacent the paper path pulls the copy paper from the supply web into the inlet. A photocopying component system includes at least a photoconductor, and an optics system for imaging an original to be copied onto the photoconductor, for continuously imprinting an image to be copied on the web of copy paper as it traverses the copier chassis through a defined, generally semicircular paper path. A drive means is positioned on the chassis sequentially behind the photocopying component system on the flowpath for pulling the copy paper web from the photocopying component system to the copier outlet. A guide means supports the web of copy paper as it traverses the copier chassis between the inlet and outlet and along the generally semicircular curved paper path. A braking system associated with the supply web maintains constant speed of the paper web between the copier inlet and the copier outlet and thus prevent interruption of the continuous copying process which normally occurs when a slackness of the web triggers "jam" switches that cut off the photocopy process.

10 Claims, 6 Drawing Figures

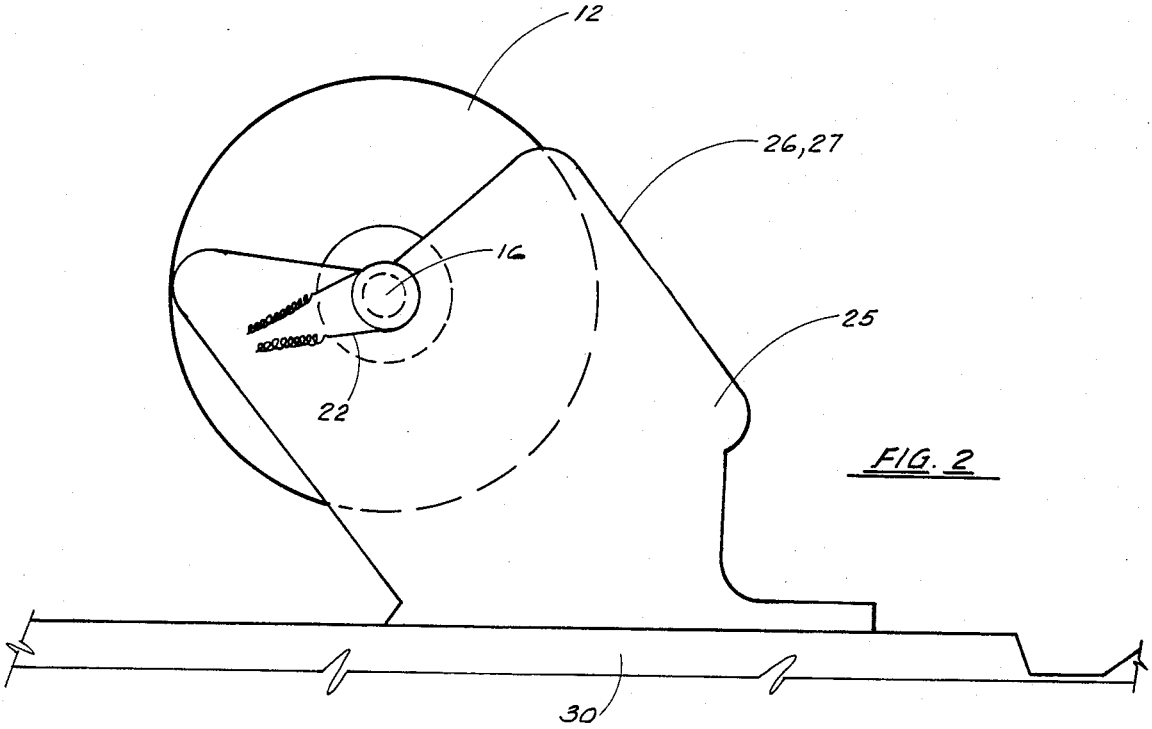
FIG. 2
FIG. 3
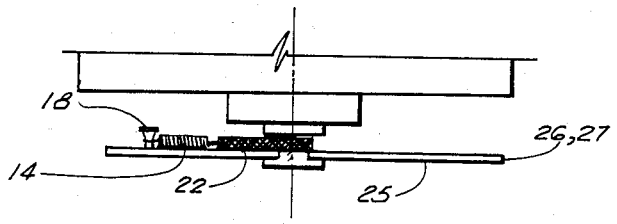
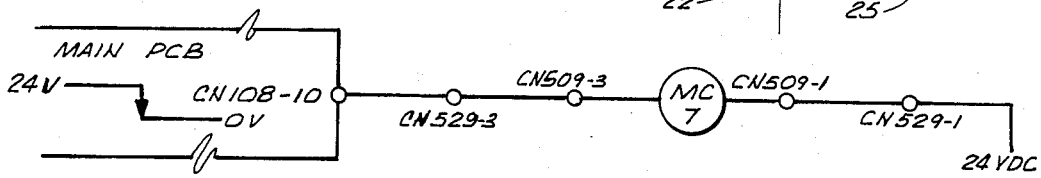
FIG. 4 - EXISTING CIRCUIT
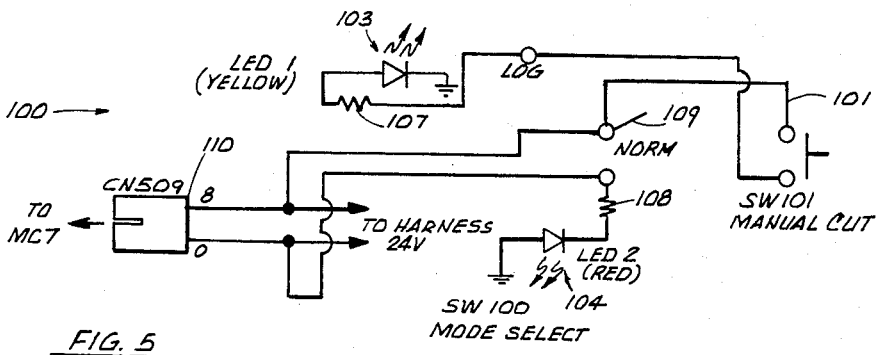
FIG. 5
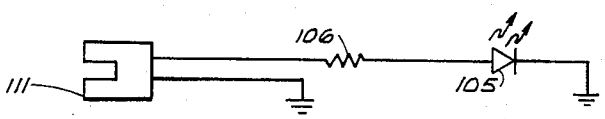
FIG. 6

CONTINUOUS COPYING APPARATUS

BACKGROUND OF THE INVENTION

1. Technical Field

The present invention relates to paper handling devices for feeding copy paper through photocopying machines and like devices, and more particularly, the present invention relates to a continuous feed photocopying apparatus with improvements in paper supply, feed path, and the related guide mechanisms for such photocopying machines.

2. Background Art

There are numerous copying devices in commercial use which use a xerographic process or like dry method of high speed copying that include a component system having at least a selenium drum for imprinting an image to be copied on a supply of copy paper. Such xerographic copy machines are an ever present piece of equipment in virtually every office in this country. The machines are manufactured and/or marketed by a number of different companies under numerous trademarks including Ricoh, Xerox, Savin, Cannon, and many others. Some of these xerographic copying devices provide a continuous photocopying capability which allows an elongated original to be continuously copied. These types of continuous copiers in general, for example, can be seen in U.S. Pat. No. 4,191,467 and U.S. Pat. No. 4,264,200. These referenced patents however are "one way" systems in which the paper path is generally elongated and straight, i.e., the copy paper supply enters one side panel of the machine and exits a copy paper outlet on the opposite side panel of the machine. The paper path between the inlet and outlet is generally a straight linear path. Generally a straight path or linear path design presents little or no problem with maintaining proper tension on the supply paper as it traverses the machine. "Straight through" paper path designs such as the following listed patents require an excessive amount of floor space and cannot be placed in restricted spaces, small areas and in corners of a room.

One particular prior art type continuous copying machine is marketed by Ricoh of America under the trademark and model number "Ricoh 420." That particular machine cannot continuously copy very long documents but rather copies a document of up to, for example, five feet (5') in length. The Ricoh 420 device does in fact have a paper inlet and a paper outlet on the same side of the machine, so that it is compact and can be placed in a corner of a room and in very small places. The operator of course can visually inspect supply paper inlet and outlet portions of the machine from one side, watching both the supply paper being fed into the machine from a lower elevation as well as the copied portion of the web being discharged from a higher elevational outlet. This machine suffers, however, in that the paper necessarily must follow not a straight but a curved, generally semicircular paper path. In attempting to follow a curved paper path, the copy paper has a tendency to become slack. This "slackness" can trigger jam switches that shut off the photocopying process. The jamming problem is aggravated when extremely long documents need to be copied such as, for example, oilfield well logging reports which may be, for example, forty to fifty feet (40'-50") in length.

Various xerographic machines and associated paper feed mechanisms have been patented which have attempted to solve the problem of continuous photocopying, or the feeding of an elongated original document for the purpose of copying. Several of these prior patented copy machines relate to the conveyance of folded computer printout paper, for example. Other patented devices as discussed below relate to the continuous feed of an elongated, continuous supply paper.

U.S. Pat. No. 3,800,922 entitled "Apparatus for Feeding Elongated Document to Electro-Photographic Copier" issued to Seiichi Yamagishi of Tokyo, Japan shows an apparatus comprising a document guide portion for receiving the document face up while permitting the operator to read the document therethrough, first drive means for forcibly driving the document received therein, a document reversing guide formed with a document passage by which the document driven by the drive means is turned face down at one end of the document table, second drive means disposed at the outlet of the document passage and including driven rollers rollingly engageable with the document under the torque thereof due to gravity to drive the document onto a document table glass at a higher circumferential speed than the first drive means, third drive means rollingly engageable with the document under gravity and to be driven at a higher circumferential speed than the second drive means, and fourth drive means disposed at the terminal end of the document table glass and including driven rollers rollingly engageable with the document under gravity, the fourth drive means being drivable at a higher circumferential speed than the third drive means only in the normal direction and idly rotatable in the reverse direction. This patent is a tractor drive unit for originals.

U.S. Pat. No. 3,997,093 issued to Aizawa et al. on Dec. 14, 1976 shows a web feed apparatus which is removably mounted on a copying machine, for feeding a web, such as an output medium of a computer, as it is paid out of a web supply tray. The apparatus comprises pin chains for driving the web, a roller for reversing the direction of movement of the web driven by the pin chains, a conveyor pivotally movable between a horizontal position and a vertical position, an operating device for operating the pin chains, a discharged web receiving tray disposed beneath the web supply tray, and a window for taking readings on the scale attached to the copying machine and indicating the sizes of copy sheets. This device pertains to the feeding of an original.

A "Sprocket Drive and Stripper Arrangement for Computer Form Feeder Apparatus" is seen in U.S. Pat. No. 4,010,882 which issued to Carl L. Turner in March of 1977. The sprocket drive device for a computer form feeder for transporting a computer printout web has a predeterminedly spaced apertures along the edges thereof along the upper and lower surfaces and about a free end of a copyboard overlying the copy platen of a copying machine, including a pin chain assembly mounted on spaced driven sprocket and idler wheels. The pin chain assembly includes a plurality of predeterminedly spaced pins extending therefrom for receipt in the spaced apertures of the web.

U.S. Pat. No. 4,079,876 entitled "Computer Forms Feeder" shows a document feeder capable of handling continuous length document materials such as computer fanfold, the feeder having spaced belts with angled projections thereon adapted to engage perforations in the document material to cause the document material to ride up on the projections during a feed cycle to lift the document material from the copy platen of the machine and prevent scrubbing of the document thereon. This is an original feed unit.

A dual purpose removable cassette for a reproducing apparatus is provided in U.S. Pat. No. 4,086,007, as well as a reproducing apparatus employing the cassette. The cassette is adapted to support both a supply of copy sheet material in the form of a fanfold web as well as an extra long document which may be in either a coiled form or a fanfold form. This is a "straight through" paper path and the paper is being pulled through the machine.

U.S. Pat. No. 4,087,172 issued to Van Dongen in May of 1978 shows a xerographic copying apparatus adapted for copying either individual or fanfold originals. For the latter, a removable fanfold handler and feeder is provided with controls to permit positioning and advance of the fanfold sheets to be correlated with the copying apparatus operation. This device has to do with original feed.

U.S. Pat. No. 4,185,760 which issued in January of 1980 shows an apparatus for concurrently feeding elongated documents and substantially correspondingly sized copy paper to a reproducing apparatus which includes a collapsible, vertically extending A-frame having a pair of opposed, divergent sides each of inverted U-shape, and pivotally interconnected at the tops thereof. One of the sides of the A-frame journals a horizontal paper roll-supporting element, and the other side of the frame carries a horizontal paper guide bar. This device is a "straight through" paper path and the paper is being pulled through the machine.

U.S. Pat. No. 4,191,457 entitled "Dual Mode Catch Tray" issued to Richard Schieck in March of 1980, and shows a dual purpose document and copy sheet receptacle for reproducing apparatus pivotally mounted at the copy output end of the apparatus and capable of acting as a copy catch tray in a first position or mode of operation and when pivotted to second position as a document catch tray in a second mode of operation. This device has to do with the receiving of a copied document or original.

U.S. Pat. No. 4,264,200 issued to Donald Tickner on Apr. 28, 1981, shows an automatic electrostatographic duplicating machine in which computer fanfold documents are fed by an automatic handling means from a supply position above the machine platen to a second position overlaying the platen below the supply position by a tractor means having motor driven sprocket means operative to advance the document material, and control means for supplying control signals to said motor driven means to advance the document material continuously, intermittently, or to selected position. This device pertains to the feeding of an original.

GENERAL DISCUSSION OF THE PRESENT INVENTION

The present invention provides a continuous photocopying system which includes a copier chassis having an inlet and an outlet which are on a common side of the copier chassis. A web of copy paper comprises a compactly stored continuous elongated web supply which is positioned on the chassis to continuously feed copy paper from the web into the inlet. A first roller drive positioned on the chassis at the copy paper inlet pulls copy paper from the supply web into the inlet. A photocopying component system includes at least a drum for continuously imprinting an image at be copied on the web of copy paper as it traverses the copier chassis. A second roller drive positioned on the chassis at the copy paper outlet and sequentially behind the photocopying component system pulls the copy paper web from the photocopying component system to the outlet. A series of guide rollers supports the web of copy paper as it traverses the copier chassis between the inlet and outlet along a generally semicircular paper path. Means is provided for maintaining constant speed of the paper web between the copier inlet and the copier outlet. In the preferred embodiment, the supply web of paper is a continuous web in the form of a roll wound upon a spool. The continuous photocopying apparatus also includes a means for applying tension to the web of the copy paper as forming part of the maintaining means.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 2 is a fragmentary view of the preferred embodiment of the apparatus of the present invention illustrating the paper web supply roll and brake portions thereof;

FIG. 3 is another fragmentary view of the preferred embodiment of the apparatus of the present invention illustrating the paper web supply roll and brake portions thereof;

FIG. 4 is an electric circuit diagram of one prior art type switching mechanism associated with photocopying machines; and FIGS. 5 and 6 are electric circuit diagrams of the preferred embodiment of the apparatus of the present invention illustrating the switching mechanism associated therewith.

DETAILED DESCRIPTION OF THE PREFERRED EMBODIMENT

Figure 1:
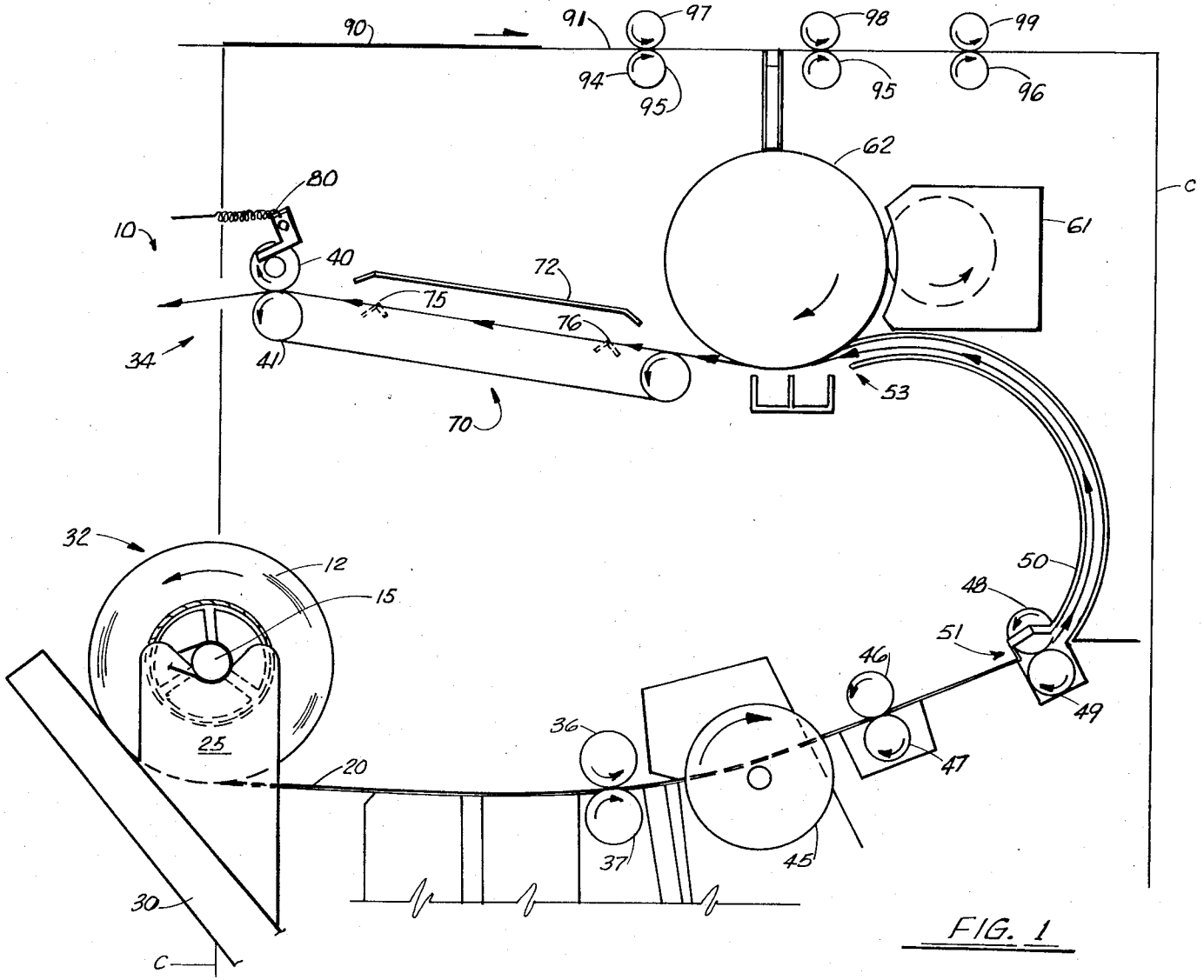
FIG. 1 is a schematic view of the preferred embodiment of the apparatus of the present invention illustrating the paper web flow path.

FIG. 1 best illustrates the preferred embodiment of the apparatus of the present invention designated generally by the numeral 10.

In FIG. 1 there can be seen a paper supply roll 12 including paper spindle 15 associated with elongated paper supply web 20 wound thereon. Brake pad 22 surrounds the spindle shaft 16 and applies tension to the spindle shaft 16 supply roll through a pair of springs 14. Springs 14 each affix at one end to brake pad 22 and at the other end to spring anchor 18 which can be a structurally supported stud laterally extending from supply roll carriage 25. Carriage 25 includes a pair of spaced apart, generally parallel brackets 26, 27 which extend from paper supply door 30. Door 30 pivotally attaches to chassis C which can be a structural steel chassis or the like. Chassis C is only schematically shown because such a copier chassis is a well-known structure upon which the various components of the copier are mounted and attached. The chassis includes a copy paper inlet 32 and a copy paper outlet 34 on a common side of the copier chassis C. Note that the supply 12 of copy paper is mounted upon carriage 25 at inlet 32 so that the continuous web 20 of supply paper is positioned to feed into the inlet 32. A first roller drive including upper and lower rollers 36, 37 are positioned on the chassis at the inlet 32 so that the web 20 of supply paper is initially frictionally engaged by the drive rollers 36, 37. Upper roller 36 can be an idler roller if desired. The lower paper feed drive rollers 36, 37 and an upper pair of paper feed drive rollers 40, 41 move the paper sequentially through the various apparatus components during copying.

The various remaining components of the supply paper web path will now be discussed with particular reference to FIG. 1. A cutting assembly 45 severs the paper web after the copying of a particular document is completed. The cutting assembly can be operated through a cutting cycle using a photocopier, for example (see FIG. 5). Idler rollers including upper and lower registration rollers 46, 47 support the web as the paper web 20 leaves the cutting assembly 45 and traverses further through the machine. Upper and lower crimp rollers 48, 49 are positioned at the inlet 51 of paper turn-around guide 50. Guide 50 is a generally semicircular guide which changes/reroutes the direction of paper web 20 so that the paper web 20 enters guide 50 at 51 and exits at 53 in a direction generally one hundred eighty degrees (180°) from the initial paper web 20 direction upon entering inlet 51. The new direction sends the paper web 20 toward outlet 34 which is vertically above inlet 32 and on the same side of chassis C. After leaving the paper turn-around guide 50, a developer unit 61 in combination with selenium drum 62 and transfer separation corona assembly 63 from part of a conventional xerographic copying system designated generally by the numeral 60. After exiting the xerographic copying system 60, a forward fuser transport assembly 70 continues movement of the paper web 20 toward outlet 34. Light shield 72 is positioned above the paper web 20 and a pair of spaced apart jam detect switches 75, 76 are positioned above fuser transport assembly 70. Any slackness in the paper web at this point causes either of the switches 75, 76 to break the circuit and cease copying. At this point a "jam" light or the like could be actuated to indicate the presence of this slackness or "jam." Exit drive rollers 40, 41 pull the paper web from the internal chassis through the paper outlet. A tensioner assembly 80 in combination with exit idler rollers 40, 41 provide the final drive mechanism to remove the paper web 20 from the chassis C through outlet 34.

The original document to be copied, designated generally as 90 in FIG. 1 can be of virtually unlimited length. Original document 90 is placed upon the upper surface 92 of chassis C which defines an original surface feed table 91. Multiple drive rollers 94, 95, 96 and associated multiple idlers 97, 98, 99 move original 90 across table surface 91 during the xerographic copying process.

In order to prevent slackness of web 20, brake pad 22 applies friction to spindle shaft 16 and thus to roll 12 and to web 20. By adapting the tension of springs 14, the speed which any of the drive rollers 36, 37 or 40, 41 can move web 20 is controllable, providing that drive rollers 36, 37 and 40, 41 will slip with respect to web 20 when such tension is applied. By adapting the spacing between rollers 36, 37 and between rollers 40, 41 a light frictional engagement of the drive rollers 36, 37 or 40, 41 with web 20 can be obtained. Absent tension by brake 22, web 20 is conveyed by the rollers 36, 37 and 40, 41 at the rotational speed of the rollers. If rollers 36, 37 rotate at a speed faster than rollers 40, 41 a slackness or "jam" can occur, actuating switch 75 or 76 to shut off the copying process. However, with brake 22 operating, tension applied to web 20 will prevent rollers 36, 37 from increasing the web 20 speed at rollers 36, 37. Thus, tension in the web 20 can be maintained between supply roll 12 and drive rollers 40, 41—the entire traverse of the webb 20 as it passes through chassis C. Such tension in webb 20 can effectively maintain constant speed of the web 20 between the copier inlet 32 and the copier outlet 34, notwithstanding the general one hundred eighty degree (180°) direction change which the web 20 makes in the traverse of the web 20.

Brake pad 22 can be any durable, long-lasting material which can frictionally load spingle shaft 16. Spindle 15 and its associated shaft 16 can be any suitable structural material such as high impact injection molded plastic, cast steel, or the like. Brake pad 22 would preferably be of leather, plastic, steel or the like.

FIGS. 4, 5 and 6 are electrical circuits. In FIG. 4 there is shown an existing or typical circuit which might be used with such a photocopy machine. In FIGS. 5 and 6 there can be seen the circuit which is used as a part of the preferred embodiment of the apparatus of the present invention. 100 in FIG. 5 illustrates schematically the circuit which is a mode select circuit. This allows the user to select whether the copier will be operated in a normal mode which will apply an automatic cut of, for example, a preset length of so many inches or in a manual mode where the operator will visually inspect the original and determine when the photocopying is to be stopped. In the manual mode, it should be appreciate that documents which are very long in length such as, for example, oilfield well drillings logs can be copied. These documents can typically be, for example, fifty feet in length or longer.

A manual switch 101 actuates the cutting assembly 45 (see FIG. 1) so that the web 20 is severed. Light emitting diode (LED) 103 indicates a yellow color, for example, to indicate that the machine is in the continuous cut mode. Light emitting diode (LED) 104 is, for example, a red LED which indicates that the machine is in a normal mode with an automatic cut of a preselected length. Light emitting diode (LED) 105 is a cutter position indicator which emits a yellow light, for example, that indicates where the cutter blade is physically located. Resistors 106, 107, and 108 respectively drop the voltage to a permissible level so that each respective LED associated with that resistor can be properly supplied with current.

Component 110 is a connector which is physically located with the chassis C. This connector 110 interfaces with the particular circuitry as shown in FIG. 5. Component 111 is a photocoupler, for example, which is positioned adjacent the cutting assembly 45 and gives the position of the blade in the machine. It should be understood that the cutting assembly 45, and components 110, 111 are existing components presently commercially available with copy machines such as, for example, the Ricoh Model 420 marketed by Ricoh of America, Inc.

Because many varying and different embodiments may be made within the scope of the inventive concept herein taught, and because many modifications may be made in the embodiments herein detailed in accordance with the descriptive requirement of the law, it is to be understood that the details herein taught are to be interpreted as illustrative and not in a limiting sense.

What is claimed as the invention is:

1. A continuous copying apparatus comprising:

a. a copier chassis having a copy paper inlet and a copy paper outlet on a common side of the copier chassis;

b. a supply web of copy paper comprising a compactly stored continuous elongated web which is positioned at the chassis to continuously feed the copy paper web into the inlet;

c. first roller drive means positioned on the chassis and adjacent the paper path for pulling copy paper from the supply web into the inlet;

d. a photocopying component system including at least a photoconductor, and an optics system for imaging an original to be copied onto the photoconductor for continuously imprinting an image to be copied on the web of copy paper as it traverses the copier chassis along a defined paper path;

e. drive means positioned on the chassis and sequentially behind the photocopying component system for pulling the copy paper web from the photocopying component system to the copier outlet;

f. guide means for supporting the web of copy paper as it traverses the copier chassis between the inlet and outlet along a generally semicircular paper path;

g. means for maintaining constant speed of the paper web between the copier inlet and the copier outlet so that very long, continuous documents can be copied; and h. manual cut means for severing the copy paper web after a visual inspection indicates that the terminal end of the original has reached the optics.

2. The continuous copying apparatus of claim 1, wherein the supply web of paper is a continuous web in the form of a roll wound upon a spool.

3. The continuous copying apparatus of claim 1, wherein the maintaining means comprises means for applying tension to the web of copy paper.

4. The continuous copying apparatus of claim 2, wherein the maintaining means comprises brake means associated with the spool for applying friction to the spool while the web of copy paper is dispensed from the web, such as during copying.

5. The continuous copying apparatus of claim 2, the first roller drive means includes a pair of drive rollers frictionally engaging opposite sides of the web.

6. The continuous copying apparatus of claim 5, wherein the frictional engagement of the web by the pair of drive rollers is slight so that the web can slip with respect to the roller surfaces.

7. The continuous copying apparatus of claim 6, wherein one of the set of drive rollers rotates at a higher speed than the other set of drive rollers and the maintaining means tensions the web so that the roller surfaces of the higher speed rollers slides with respect to the web.

8. The continuous copying apparatus of claim 1, wherein the paper path is curved.

9. The continuous copying apparatus of claim 1, wherein the paper outlet is vertically above the paper inlet.

10. The continuous copying apparatus of claim 1, wherein the maintaining means includes means for maintaining the web of paper in tension between the inlet and outlet.

* * * * *